US009908026B2

(12) United States Patent
Heideman

(10) Patent No.: US 9,908,026 B2
(45) **Date of Patent: *Mar. 6, 2018**

(54) ADJUSTABLE EXERCISE APPARATUS

(71) Applicant: Gordon M. Heideman, Huntington Beach, CA (US)

(72) Inventor: Gordon M. Heideman, Huntington Beach, CA (US)

( * ) Notice: Subject to any disclaimer, the term of this patent is extended or adjusted under 35 U.S.C. 154(b) by 31 days.

This patent is subject to a terminal disclaimer.

(21) Appl. No.: 15/008,367

(22) Filed: Jan. 27, 2016

(65) Prior Publication Data

US 2016/0136503 A1 May 19, 2016

Related U.S. Application Data

(63) Continuation of application No. 13/772,223, filed on Feb. 20, 2013, now Pat. No. 9,248,329.
(Continued)

(51) Int. Cl.
*A63B 21/00* (2006.01)
*A63B 71/00* (2006.01)
(Continued)

(52) U.S. Cl.
CPC ..... *A63B 71/0009* (2013.01); *A63B 21/00* (2013.01); *A63B 21/00181* (2013.01);
(Continued)

(58) Field of Classification Search
CPC ..... A63B 2210/50; A63B 2208/0233; A63B 2021/1609; A63B 21/1457; A63B 21/1492; A63B 21/0557; A63B 21/0442; A63B 21/04; A63B 23/12; A63B 21/078; A63B 21/00047; A63B 2225/10; A63B 23/1245; A63B 2210/02; A63B 2225/09; A63B 22/0002; A63B 21/00; A63B 21/00079; A63B 21/00083; A63B 21/00087; A63B 21/0009; A63B 21/00112; A63B 21/00116; A63B 21/008; A63B 21/0081; A63B 21/0083; A63B 21/0085; A63B 21/0087; A63B 21/08; A63B 21/1453; A63B 21/148; A63B 21/1488; A63B 21/1496; A47C 9/002
(Continued)

(56) References Cited

U.S. PATENT DOCUMENTS 4,911,435 A 3/1990 Johns
5,100,125 A 3/1992 Uplinger et al.
(Continued)

*Primary Examiner* — Andrew S Lo
(74) *Attorney, Agent, or Firm* — Knobbe, Martens, Olson & Bear, LLP

(57) ABSTRACT

Disclosed herein are various embodiments of an exercise apparatus. In certain embodiments, an exercise apparatus comprises a frame and a seat assembly, the seat assembly comprising a seat, the seat configured to move between a first position and a second position, wherein the first position accommodates use of the exercise apparatus by a user sitting on the seat and wherein the second position accommodates use of the exercise apparatus by a user sitting in a wheelchair. The seat assembly may be pivotably coupled to the frame. The seat assembly may comprise a stop configured to inhibit movement of the seat, and may further comprise a biasing element that is biased to disengage the stop.

18 Claims, 9 Drawing Sheets

Related U.S. Application Data

(60) Provisional application No. 61/601,516, filed on Feb. 21, 2012.

(51) Int. Cl.

| | |
|---|---|
| ***A63B 21/062*** | (2006.01) |
| ***A63B 23/035*** | (2006.01) |
| ***A63B 23/12*** | (2006.01) |
| *A63B 21/02* | (2006.01) |
| *A63B 21/055* | (2006.01) |
| *A63B 22/00* | (2006.01) |
| *A63B 21/008* | (2006.01) |

(52) U.S. Cl.

CPC ..... *A63B 21/055* (2013.01); *A63B 21/062* (2013.01); *A63B 21/063* (2015.10); *A63B 21/0628* (2015.10); *A63B 21/151* (2013.01); *A63B 21/152* (2013.01); *A63B 21/4033* (2015.10); *A63B 21/4035* (2015.10); *A63B 21/4047* (2015.10); *A63B 23/03525* (2013.01); *A63B 23/1209* (2013.01); *A63B 21/008* (2013.01); *A63B 21/026* (2013.01); *A63B 21/0552* (2013.01); *A63B 21/15* (2013.01); *A63B 22/0076* (2013.01); *A63B 23/03541* (2013.01); *A63B 2022/0084* (2013.01); *A63B 2071/0018* (2013.01)

(58) Field of Classification Search

USPC .... 482/92–94, 114–120, 129–130, 133–139, 482/142

See application file for complete search history.

(56) References Cited

U.S. PATENT DOCUMENTS

| | | | | |
|---|---|---|---|---|
| 5,221,064 | A | 6/1993 | Hodges | |
| 5,277,685 | A | 1/1994 | Gonzales | |
| 5,362,297 | A | 11/1994 | Muir | |
| 5,643,152 | A | 7/1997 | Simonson | |
| 5,667,464 | A | 9/1997 | Simonson | |
| 5,762,593 | A | 6/1998 | Whiteley | |
| 5,776,039 | A | 7/1998 | Perez, Jr. | |
| 5,807,219 | A | 9/1998 | Webber et al. | |
| 5,833,585 | A | 11/1998 | Jones et al. | |
| 6,019,705 | A | 2/2000 | Anderson | |
| 6,254,516 | B1 | 7/2001 | Giannelli et al. | |
| 6,302,833 | B1 | 10/2001 | Ellis et al. | |
| 6,347,777 | B1 | 2/2002 | Webber et al. | |
| 6,447,430 | B1 | 9/2002 | Webb et al. | |
| 6,551,226 | B1 | 4/2003 | Webber et al. | |
| 6,705,976 | B1 | 3/2004 | Plane, Jr. | |
| 6,988,977 | B2 | 1/2006 | Webber et al. | |
| 7,044,897 | B2 | 5/2006 | Myers et al. | |
| 7,179,209 | B2 | 2/2007 | Sechrest et al. | |
| 7,354,384 | B2 | 4/2008 | Martin et al. | |
| 7,717,824 | B2 | 5/2010 | Pinto | |
| 7,722,509 | B2 | 5/2010 | Eder | |
| 8,057,368 | B1 | 11/2011 | Lyszczarz | |
| 8,308,620 | B2 | 11/2012 | Lyszczarz | |
| 2002/0091043 | A1 | 7/2002 | Rexach | |
| 2003/0017918 | A1 | 1/2003 | Webb et al. | |
| 2005/0096194 | A1* | 5/2005 | Bond | A63B 21/055 482/92 |
| 2005/0202941 | A1 | 9/2005 | Vaes | |
| 2007/0093364 | A1 | 4/2007 | Batca | |
| 2007/0093365 | A1 | 4/2007 | Batca | |
| 2007/0117691 | A1 | 5/2007 | Sechrest et al. | |
| 2009/0017997 | A1 | 1/2009 | Piggins | |
| 2009/0181833 | A1 | 7/2009 | Cassidy et al. | |
| 2009/0203505 | A1* | 8/2009 | Kroll | A63B 21/078 482/104 |
| 2009/0209397 | A1* | 8/2009 | Miskech | A63B 21/00181 482/140 |
| 2009/0261642 | A1 | 10/2009 | Dickie | |
| 2013/0069413 | A1 | 3/2013 | Matthews | |

* cited by examiner

FIG. 3A
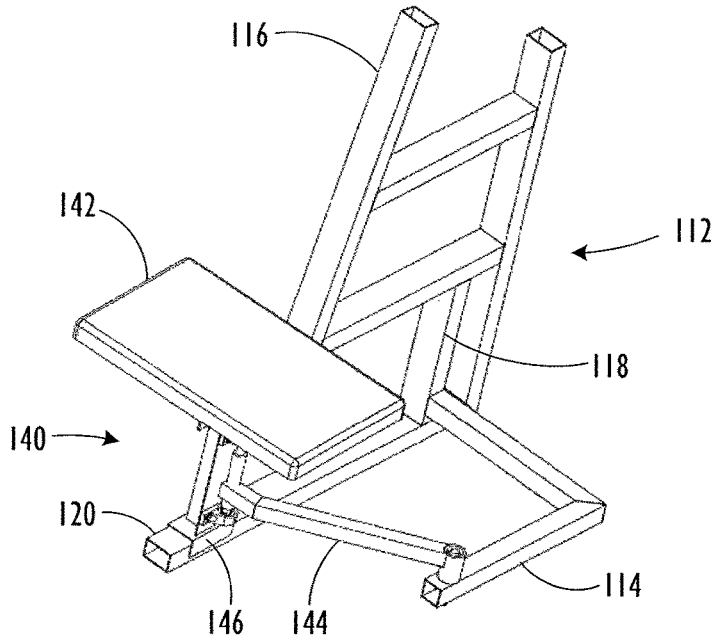
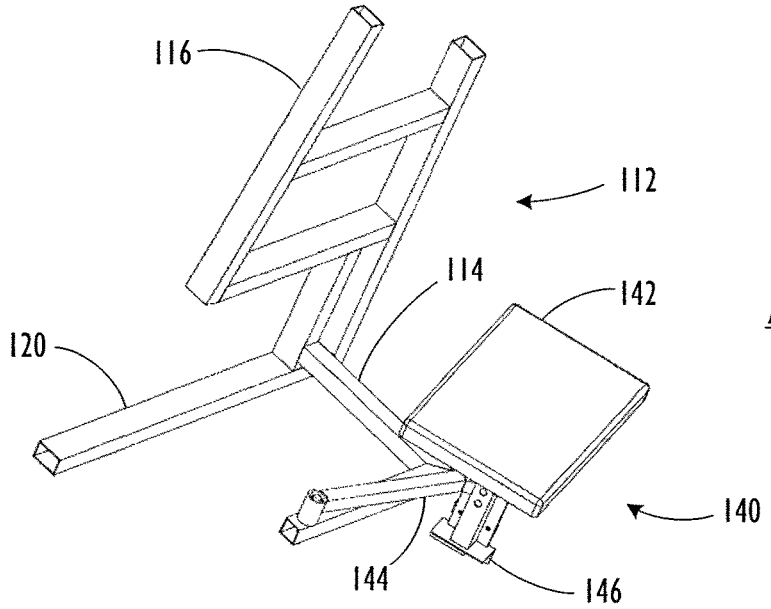
FIG. 3B

ADJUSTABLE EXERCISE APPARATUS

CROSS-REFERENCE TO RELATED APPLICATIONS

This application is a continuation of U.S. Non-provisional application Ser. No. 13/772,223, entitled ADJUSTABLE EXERCISE APPARATUS and filed on Feb. 20, 2013, which claims the benefit of U.S. Provisional Application No. 61/601,516, entitled ADJUSTABLE EXERCISE APPARATUS and filed on Feb. 21, 2012, the entirety of which is incorporated herein by reference.

BACKGROUND

Field of the Invention

The present application relates generally to exercise equipment, and more particularly to exercise equipment that provides increased adjustability and/or easier access for users in wheelchairs.

Description of the Related Art

Exercise is critical to the health and well-being of individuals. While there has been a substantial increase in the number and types of exercise systems in recent years, these systems often cannot be easily accessed and used by individuals with disabilities or physical challenges, such as persons in wheelchairs.

SUMMARY

The present application discloses various embodiments of an exercise apparatus comprising novel features that result in an apparatus that is flexible in its configurations, easy to use, and capable of accommodating individuals of various sizes, strengths, and abilities, including but not limited to individuals in wheelchairs. The embodiments disclosed herein allow fitness centers and gyms to be more inclusive of people with disabilities, such as people in wheelchairs, and provide disabled people the opportunity to exercise in the same facilities and use the same equipment as their able-bodied friends and family members. Without limiting the scope of this disclosure, some of the features will now be discussed briefly.

In some embodiments disclosed herein, an exercise apparatus comprises an exercise station adapted to allow both able-bodied users and disabled users, including those in wheelchairs, to perform the exercise from substantially the same position. In some embodiments, an exercise apparatus comprises a resistance system coupled to an exercise station, and the exercise station comprises a frame, an arm assembly, and a seat assembly. The seat assembly may comprise a seat having a first position and a second position, wherein the first position accommodates use of the exercise apparatus by a user sitting on the seat and wherein the second position accommodates use of the exercise apparatus by a user seated in a wheelchair. The seat may be configured to move between the first position and the second position. In some embodiments, the second position is sufficiently removed from the first position to allow a user in a wheelchair to maneuver the wheelchair into the approximate location of the seat in the first position and to perform the exercise from the wheelchair. In some embodiments, the seat assembly is pivotably attached to the frame. The apparatus optionally comprises a frame extension, and the support member may be pivotably attached to the frame extension.

In some embodiments, the exercise station may comprise a means for securing the seat in the first position. For example, the means for securing the seat may comprise a stop. The stop may contact a surface and inhibit movement of the seat while a user is performing an exercise with the seat in the first position. The stop optionally comprises a horizontal portion that frictionally engages a surface. In some embodiments, the frame may comprise a retaining element and the stop may frictionally engage the retaining element. In some embodiments, the stop may further comprise a vertical portion that contacts the retaining element when the seat is in the first position.

In some embodiments, the means for securing the seat in the first position comprises a latch. In some embodiments, the means for securing the seat in the first position comprises a pull-pin adapted to engage a hole in the retaining element of the frame.

In some embodiments, the seat assembly comprises a biasing element that is biased to disengage the means for securing the seat in the first position. For example, where a seat assembly comprises a stop, the seat assembly may comprise a biasing element that biases the stop away from a surface. In some embodiments, the biasing element may be a spring or a hydraulic piston.

In some embodiments, the arm assembly comprises two or more handles. The location of the handles with respect to the user may be adjustable. The distance between the handles may also be adjustable.

The arm assembly may comprise a primary element coupled to an extension element and a handle element coupled to the extension element. The extension element may be moveable relative to the primary element and the handle element may be moveable relative to the extension element. The extension element may extend at an angle from the primary element. The angle between the extension element and the primary element may be adjustable. The handle element may extend at an angle from the extension element. The angle between the handle element and the extension element may be adjustable. In some embodiments, the extension element may be slideable and/or rotatable relative to the primary element. In some embodiments, the handle element may be slideable and/or rotatable relative to the extension element. In some embodiments, each of the handle elements may operate independently of the other. Alternatively, the arm assembly may be configured such that the handles operate together. For example, the primary elements may be rigidly coupled together.

In some embodiments, a handle assembly may be coupled to each handle element. The handle assembly may comprise one, two, three, or more handles. In some embodiments, the handle assemblies may be rotatable. In some embodiments, each handle assembly may comprise three handles, and each of the three handles may comprise the same or a different type of grip.

In some embodiments, the weight of the arm assembly may be at least partially counter-balanced. In some embodiments, the counterbalancing is sufficient to reduce the effective weight of the arm assembly to between about 0 pounds and about 10 pounds. In some embodiments, the counterbalancing is sufficient to reduce the effective weight of the arm assembly to between about 1 pound and about 5 pounds.

In some embodiments, the resistance system may comprise one or more weight stacks. In some embodiments, the resistance system may comprise a primary weight stack comprising multiple individual plates of a first weight and a secondary weight stack comprising multiple individual plates of a second weight, wherein the primary and secondary weight stacks are coupled together such that the amount of resistance supplied to the exercise station is the total weight from both weight stacks. In some embodiments, the weight of each individual plate in the secondary weight stack is one-tenth of the weight of an individual plate in the primary weight stack.

The exercise apparatus may comprise a means for adjusting the height of the seat. In some embodiments, a seat assembly comprises a seat, a seat anchor, a seat base, and a seat height adjustment mechanism. In some embodiments, the seat height adjustment mechanism comprises a pivot point, a lever comprising a first portion that extends substantially horizontally beneath the seat from the pivot point and a second portion that extends substantially vertically from the pivot point to the seat base, and a pin coupled to the second portion of the lever and adapted to engage holes in the anchor and base and thereby secure the seat at the desired height.

In some embodiments, a seat assembly for an exercise station may comprise a seat upon which a user may sit when performing an exercise, the seat adapted to move between a first position and a second position, a seat base, a stop adapted to contact a surface and inhibit lateral movement of the seat, a support member, and a biasing element. The biasing element may bias the stop away from the surface. In some embodiments the stop contacts the surface and inhibits lateral movement of the seat when the seat is in the first position and a user sits on the seat.

In certain embodiments, an exercise apparatus may comprise a resistance system coupled to an exercise station, the exercise station comprising a height-adjustable seat adapted to move between a first position in which the user can perform an exercise by sitting on the seat and a second position sufficiently removed from the first position to allow a user in a wheelchair to maneuver the wheelchair into the location of the seat in the first position and to perform the exercise from the wheelchair. The exercise station may optionally comprise a cantilever frame.

In some embodiments, a seat assembly may be adapted to be coupled to a pre-existing exercise station. The seat assembly may comprise a seat upon which a user may sit when performing an exercise, a seat base, a stop, and a support member pivotably coupled to a frame extension. In some embodiments, the seat may be adapted to move between a first position and a second position. In some embodiments, the frame extension may be adapted to be coupled to the frame of an exercise station. In some embodiments, the seat assembly may further comprise a biasing element that is biased to disengage the stop.

In some embodiments disclosed herein, a seat is adapted to be coupled to a frame of an exercise station, and the seat assembly may comprise a seat to accommodate a user performing an exercise, a means for inhibiting movement of the seat when a user sits on the seat in the first position, a support member coupled to a frame extension, and a means for facilitating movement of the seat between the first position and the second position. In some embodiments, the frame extension may be adapted to be coupled to a frame of an exercise station. In some embodiments, the seat may be adapted to move between a first position and a second position.

In some embodiments, the means for facilitating movement of the seat between the first and second position comprises a pivot that allows the support member to pivot relative to the frame extension. Alternatively, the means for facilitating movement of the seat between the first and second positions may comprise a hinge.

In certain embodiments, a method of adapting an exercise apparatus comprising an exercise station to be wheelchair accessible comprises providing a seat assembly comprising a support member coupled to a seat having a first position and a second position, wherein the first position accommodates use of the exercise apparatus by a user sitting on the seat and wherein the second position accommodates use of the exercise apparatus by a user seated in a wheelchair, providing a frame extension pivotably coupled to the support member, and coupling the frame extension to a frame of an exercise station. In some embodiments, the method further comprises removing a pre-existing seat from the exercise station.

In some embodiments, methods of manufacturing an exercise apparatus, or various aspects thereof, are described. For example, disclosed herein are novel methods of manufacturing an exercise station, a seat assembly, an arm assembly, a moveable seat, a height-adjustable seat, etc.

In some embodiments, an exercise apparatus comprises a resistance system coupled to an exercise station, the exercise station comprising a cantilever frame, an arm assembly, a seat assembly comprising a seat having a first position and a second position, wherein the first position accommodates use of the exercise station by a user sitting on the seat and wherein the second position accommodates use of the exercise station by a user sitting in a wheelchair, and wherein the seat is configured to move between the first position and the second position, and a means for securing the seat in the first position. In some embodiments, the cantilever frame comprises a back support structure configured to permit, with the seat in the second position, the seat of an electric wheelchair to be in the approximate location of the seat in the first position. The back support structure may be raised sufficiently to allow the components rearward of the seat of the electric wheelchair to extend below the back support structure.

In some embodiments, the seat assembly comprises a biasing element that is biased to disengage the stop. The biasing element may have a vertical bias that raises and disengages the stop when no downward force is exerted on the seat and lowers and engages the stop when the seat is in the first position and a user sits on the seat. In some embodiments, the seat is moveable between the first and second positions without any vertical lifting force.

In some embodiments, an exercise apparatus comprises a resistance system coupled to an exercise station, the exercise station comprising a cantilever frame, an arm assembly, a seat assembly pivotably coupled to the frame comprising a seat having a first position and a second position, wherein the first position accommodates use of the exercise station by a user sitting on the seat and wherein the second position accommodates use of the exercise station by a user seated in a wheelchair, and wherein the seat is configured to move between the first position and the second position, a stop adapted to inhibit movement of the seat by engaging a surface, and a biasing element that is biased to disengage the stop from the surface when the seat is in the first position and no force is exerted on the seat.

In some embodiments, the arm assembly comprises a primary element coupled to an extension element, and a handle element coupled to the extension element, wherein the extension element is moveable relative to the primary element and the handle element is moveable relative to the extension element. The distance between the handle elements may be adjustable. The arm assembly may be at least partially counter-balanced In some embodiments, an exercise apparatus comprises a resistance system and an exercise station comprising a cantilever frame, a seat adapted to move between a first position in which the user can perform an exercise by sitting on the seat and a second position sufficiently removed from the first position to allow a user in a wheelchair to maneuver the wheelchair into the location of the seat in the first position and to perform the exercise from the wheelchair, means for adjusting the height of the seat, and an adjustable arm assembly, wherein the seat is moveable between the first and second positions without lifting the seat. In some embodiments, the exercise apparatus further comprises a stop configured to inhibit movement of the seat while a user sits on the seat in the first position.

Certain embodiments combine one or more features disclosed herein in order to produce an exercise apparatus that is easily used by both able-bodied and disabled persons. For purposes of summarizing the invention and the advantages achieved over the prior art, certain objects and advantages of the invention are described herein. Of course, it is to be understood that not necessarily all such objects or advantages need to be achieved in accordance with any particular embodiment. Thus, for example, those skilled in the art will recognize that the invention may be embodied or carried out in a manner that achieves or optimizes one advantage or group of advantages as taught or suggested herein without necessarily achieving other objects or advantages as may be taught or suggested herein.

All of these embodiments are intended to be within the scope of the invention herein disclosed. These and other embodiments will become readily apparent to those skilled in the art from the following detailed description having reference to the attached figures, the invention not being limited to any particular disclosed embodiment(s).

BRIEF DESCRIPTION OF THE DRAWINGS

FIG. 3A is a perspective view of an example embodiment having a moveable seat assembly, with the seat in a first position.

FIG. 3B is a perspective view of an example embodiment having a moveable seat assembly, with the seat in a second position.

DETAILED DESCRIPTION

Although certain embodiments and examples are described below, those of skill in the art will appreciate that the invention extends beyond the specifically disclosed embodiments and/or uses and obvious modifications and equivalents thereof. Thus, it is intended that the scope of the invention herein disclosed should not be limited by any particular embodiments described below. The following detailed description sets forth several novel features for exercise equipment which, among other things, allows persons with disabilities, including but not limited to individuals confined to wheelchairs, to access and use exercise equipment. The description also sets forth novel features that increase the adjustability of the equipment, so that users of varying size, shape, strength, and ability can use the same apparatus.

Figure 1:
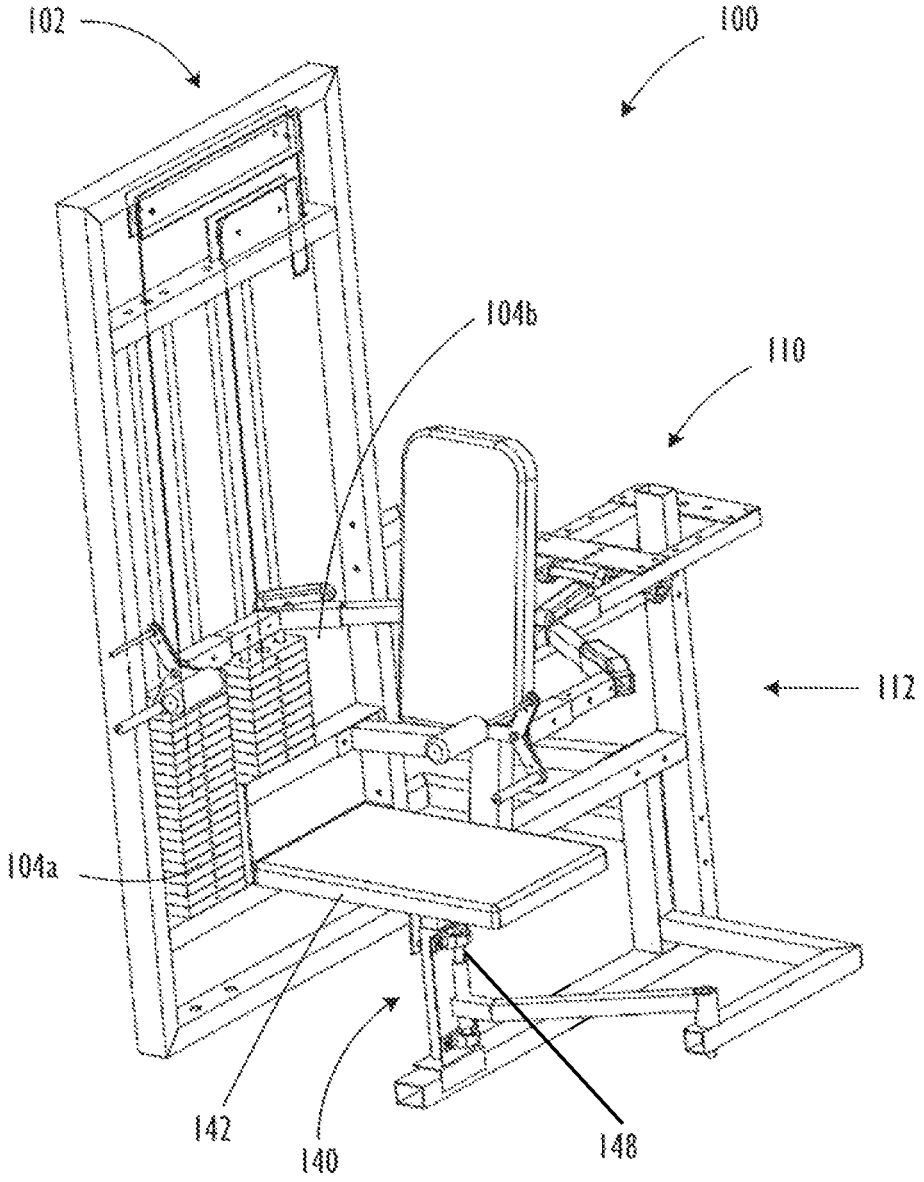
FIG. 1 is a top perspective view of an example embodiment of an exercise apparatus with a seat in a first position.

FIG. 1 illustrates an example embodiment of an exercise apparatus disclosed herein. The exercise apparatus 100 comprises an exercise station 110, at which the user performs the exercise, and a resistance system 102, which provides resistance, or a load, during the exercise. The station 110 comprises a frame 112, which provides a supporting structure for the station 110. As those of skill in the art will recognize, the frame 112 may be constructed of any suitable material, including but not limited to steel, aluminum, composites, or plastics, or any combination thereof. The frame 112 may be configured to allow a user in a wheelchair to maneuver the wheelchair such that the user can perform the exercise from the wheelchair in substantially the same position as an able-bodied user would perform the exercise using a conventional seat.

Moveable Seat Assembly

Figure 2:
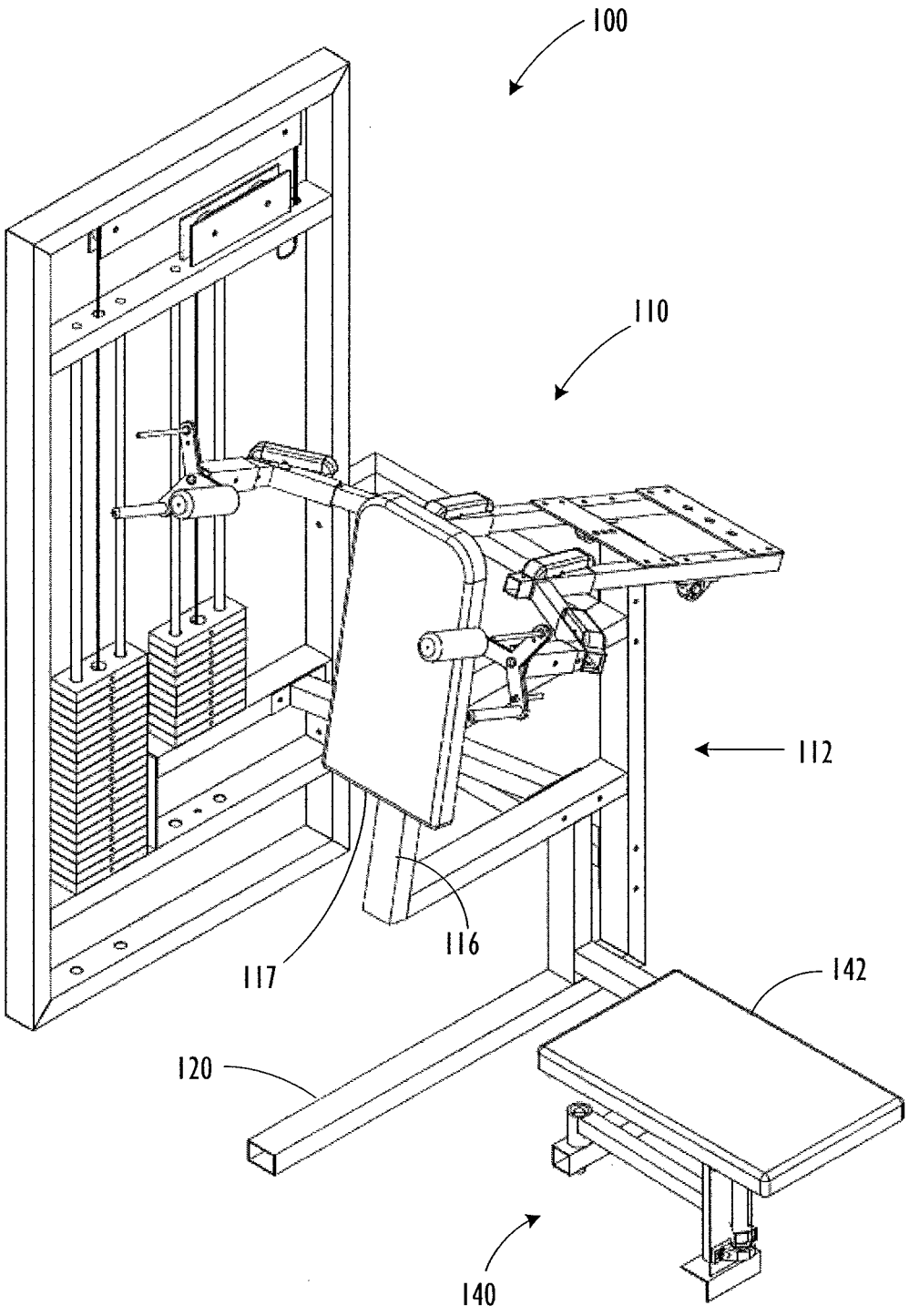
FIG. 2 is a top perspective view of an example embodiment of an exercise apparatus with a seat in a second position.

The station 110 may comprise a seat assembly 140, which includes a seat 142. In some embodiments, the seat assembly 140 may be adapted such that the seat 142 is moveable between at least a first position and a second position. When in the first position, as illustrated in FIG. 1, a user may sit upon the seat 142 to perform exercises at the station 110 in a conventional manner. When the seat is in the second position, as illustrated in FIG. 2, the station may be used from a wheelchair. In some embodiments, the user in the wheelchair is able to maneuver the wheelchair such that the wheelchair user is in substantially the same position as an able-bodied user would be when performing the exercise with the seat 142 in the first position.

FIGS. 3A and 3B illustrate a portion of an exercise station disclosed herein. As shown in FIGS. 3A and 3B, in some embodiments the seat assembly 140 comprises a seat support member 144 coupled to the frame 112. The seat support member 144 may be adapted to allow the seat 142 to move from a first position, as illustrated in FIG. 3A, to a second position, as illustrated in FIG. 3B. In some embodiments, the support member 144 is pivotably coupled to the frame 112, as shown. In some embodiments, the support member 144 is coupled to the frame using one or more hinges.

The frame 112 optionally includes an extension 114, to which the seat support member 144 may be coupled. Alternatively, the seat support member 144 may be coupled directly to a back support structure 116, or to any other portion of the frame 112. As shown in FIGS. 3A and 3B, the frame 112 may comprise one or more support elements 118 to provide additional support and stability to the exercise station 110. The seat support member 144 may optionally be coupled to any such support element.

Based on the disclosure provided herein, it will be apparent to one of skill in the art that various mechanisms may be used for adapting the seat 142 to move between a first position, which allows able-bodied users to use the exercise station in a conventional manner, and a second position, which is sufficiently removed from the first position to allow a user in a wheelchair to maneuver into the exercise position. Although the seat assembly 140 of FIGS. 1-3 are described and shown herein as comprising a support atm 144 that is pivotably coupled to the frame 112 via extension 114, the seat assembly 140 may comprise, for example, a hinge or other mechanism that allows the seat 142 to rotate or fold up or down. Alternatively, a mechanism that allows the seat 142 to rotate about a support element or the back support structure 116 may be used.

The seat assembly may comprise a mechanism that assists in maintaining the seat 142 in the first position while a user is sitting on the seat and performing an exercise. In some embodiments, the seat assembly 140 may be locked or otherwise secured in the first position. For example, to inhibit (i.e., reduce or eliminate) the movement of the seat 142 when a user is sitting on the seat and performing an exercise with the seat 142 in the first position, the seat assembly 140 may comprise a stop 146 adapted to contact a retaining element 120 of the frame 112. As shown in FIGS. 3A, 3B, 4, and 5, the stop 146 may comprise a vertical portion and a horizontal portion. The vertical portion of the stop 146 contacts the retaining element 120 to inhibit the lateral movement of the seat. For example, if a user approaches the exercise apparatus and the seat is in the second position, the user can move the seat to the first position. When the seat 142 reaches the first position, the vertical portion of the stop 146 will contact the retaining member 120, thereby preventing further lateral movement of the seat 142 and ensuring that the seat 142 is in the proper position.

The horizontal portion of the stop 146 may be adapted to engage the top of the retaining element 120. In some embodiments, the stop 146 may frictionally engage the retaining element 120. In some embodiments, at least a portion of the stop 146 and/or the retaining element 120 may comprise foam, rubber, or other material to increase friction and inhibit movement of the seat 142. For example, when the seat 142 is in the first position the horizontal portion of the stop 146 may contact the top of the retaining element. The friction between these structures, particularly when under the additional force resulting from a user sitting on the seat, may inhibit lateral movement of the seat while the user is performing the exercise.

Based on the disclosure provided herein, those of skill in the art will appreciate that numerous mechanisms may be used to secure the seat 142 in the first position during exercise. For example, the seat assembly 140 may comprise a pin adapted to engage a hole in the retaining element 120 when the seat 142 is in the first position. Alternatively, a latch may couple the seat assembly to a retaining element.

In some embodiments, the movement of the seat 142 may be inhibited by a mechanism such as a stop, pull-pin, latch, or the like that is coupled to the support member 144 or the frame 112. Such a mechanism may inhibit the movement of the support member 144 relative to the frame 112. For example, in embodiments in which the support member 144 is pivotably coupled to the frame 112, the coupling may comprise a stop that inhibits the support member 144 from pivoting beyond a predetermined position.

Figure 6:
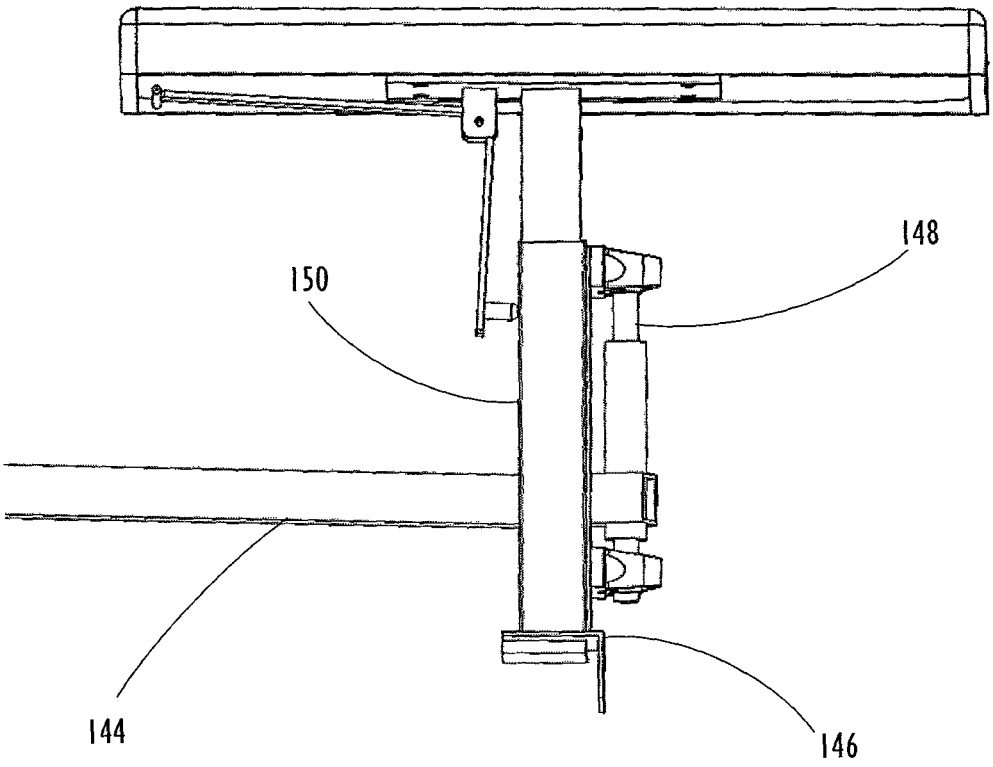
FIG. 6 is a bottom perspective view of an example embodiment of a seat assembly.

In some embodiments, the seat assembly comprises a biasing element 148 as shown in FIGS. 1 and 6. When no downward force is applied to the seat 142, for example when a user is not sitting on the seat, the vertical force of the biasing element 148 is sufficient to raise the seat 142, the seat base 150, and the stop 146 relative to the support member 144. Accordingly, the biasing element 148 raises the seat base 150 and stop 146 away from the surface of the retaining element 120 such that the horizontal portion of the stop 146 is not engaged. When downward force is exerted upon the seat and the seat is in the first position, for example, when a user is exercising with the seat in the first position, the biasing element 148 depresses, thereby lowering the seat 142, seat base 150, and stop 146 such that the stop 146 engages the surface of the retaining element 120 or another surface such as the ground. In some embodiments, when no force is applied to the seat 142, the seat can be moved from the first position to the second position without any lifting. The optional biasing element 148 allows users with disabilities, or others who are unable to lift and move conventional seats, to easily move the seat 142 from the first position to the second position. The biasing element 148 may comprise, for example, a coil spring. Other types of springs, such as leaf springs, may also be used. The biasing element 148 may alternatively or additionally comprise other resilient and/or elastic structures and materials. The biasing element 148 may optionally comprise a hydraulic system, such as a hydraulic piston.

The use of a biasing element 148 may also provide additional options for securing the seat 142 in the first position. For example, the vertical portion of the stop 146 previously described may not be necessary with the use of a biasing element 148 because the user can sit on the seat 142, thereby depressing the biasing element 148 and lowering the base of the seat 150 such that at least a portion of the seat base 150 frictionally engages the surface on which the station is placed (floor, mat, etc.). In such embodiments, the movement of the seat may be inhibited without the use of a vertical portion of the stop 146 or a retaining element 120.

Figure 4:
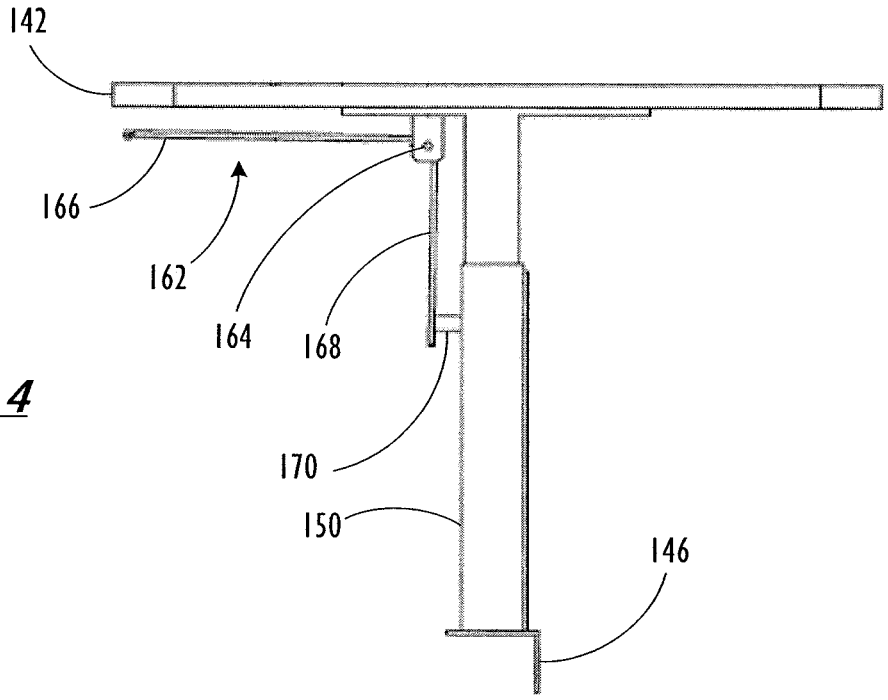
FIG. 4 is a perspective view of an example embodiment of a seat assembly.
Figure 5:
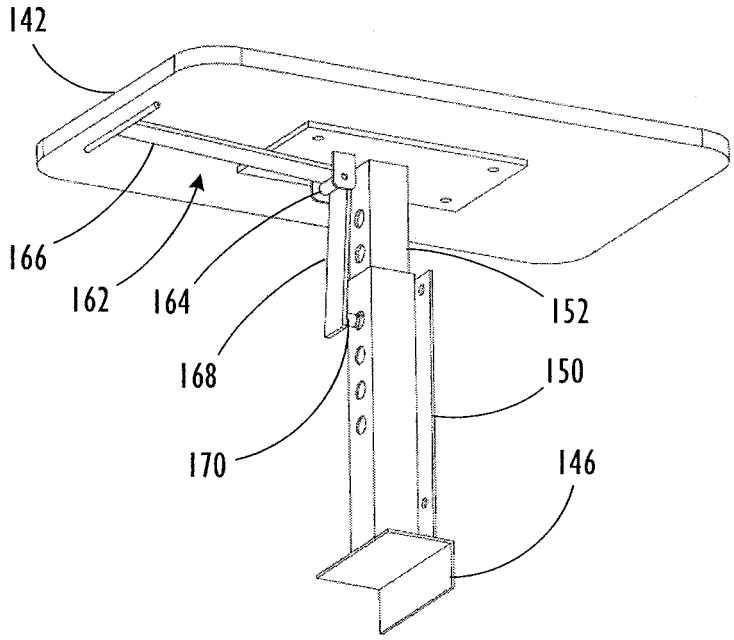
FIG. 5 is a bottom perspective view of an example embodiment of a seat assembly.

FIGS. 4 and 5 illustrate one example of a novel seat assembly 140 disclosed herein which provides a mechanism that facilitates adjustment of the height of the seat 142. The seat assembly may comprise a seat 142, a seat anchor 152, a seat base 150, and a seat height adjustment mechanism. In some embodiments, the seat support 144 (not shown) may be coupled to, or integral with, the seat base 150. In some embodiments, the user may adjust the height of the seat by moving the seat anchor 152 relative to the seat base 150. Various types of seat height adjustment mechanisms are well known in the art, such as pull-pin mechanisms, in which the user pulls a pin, adjusts the seat height, and releases the pin to lock the seat at a particular height. Most conventional seat height adjustment mechanisms require the user to use both hands, with one hand pulling the pin (or other locking mechanism) and the other hand lifting the seat.

The embodiment shown in FIGS. 4 and 5 uses a height adjustment mechanism designed to allow the seat height to be adjusted with less effort than conventional systems. In some embodiments the seat height may be adjusted with a single hand. The seat height adjustment mechanism 160 may comprise a lever configured to allow the user to adjust the height of the seat 142. In some embodiments, the seat height adjustment mechanism 160 may comprise a lever 162 that extends substantially horizontally below the surface of the seat, from a pivot point 164 near the seat anchor 152 to a point that is adjacent to the edge of the seat 142. In some embodiments, the horizontal portion 166 of the lever 162 may extend to a point that is within about 2 inches of the edge of the seat, thereby allowing most individuals to grab the edge of the seat with the palm of their hand and actuate the lever 162 with their fingers. In some embodiments, the horizontal portion 166 of the lever 162 extends to a point that is within about 1 inch of the edge of the seat, and in some embodiments the horizontal portion 166 of the lever 162 extends to a point that is about 0.5 inches from the edge of the seat. FIGS. 11A-11E provides, by way of example only and not for any limiting purposes, dimensions for various aspects of a portion of a seat assembly according to one embodiment disclosed herein.

The lever 162 may also comprise a substantially vertical portion 168, which extends from the pivot point 164 to the seat base 150. The vertical portion 168 of the lever 162 further comprises a pin 170. The seat anchor 152 and seat base 150 comprise corresponding holes through which the pin 170 can pass to secure the seat 142 at a desired height. The substantially vertical portion 168 of the lever may be any length, although in certain embodiments it is between about 4 and about 10 inches. In some embodiments, the substantially vertical portion 168 of the lever is between about 5 and about 7 inches in length.

The seat height adjustment mechanism 160 illustrated in FIGS. 4 and 5 may allow a user to adjust the height of the seat 142 by gripping the edge of the seat 142 and using his or her fingers to pull up on the lever 162, thereby releasing the pin 170 from the holes in the seat anchor 152 and seat base 150. The user can then raise or lower the seat 152 to the desired height and release the lever 162 so that the pin 170 re-engages the seat anchor 148 and seat base 150, locking the seat 142 at the desired height. Accordingly, the user need not reach below the seat to adjust the seat height, as is required in conventional pull-pin type seats.

In other embodiments, the seat height may be fixed relative to the base 150. In some embodiments, the seat height may be fixed relative to the base, but the seat height may be adjusted by adjusting the support arm 144 relative to the frame 112. In some embodiments, the seat 142 is removable. In some embodiments, the seat assembly 140 may be detached from the frame 112.

In some embodiments, the seat assembly 140 may be configured to be coupled to an existing exercise station. In such embodiments, the support member 144 may be adapted to be coupled to the frame of the pre-existing exercise station. Alternatively, the support member 144 may be pivotably coupled to a frame extension 114, and the frame extension may be adapted to be rigidly attached to the pre-existing exercise station. As those of skill in the art will appreciate, numerous methods exist for coupling the moveable seat assembly disclosed herein to a frame of a pre-existing station.

In certain embodiments, a method of manufacturing an exercise apparatus may comprise coupling a resistance system 180 to an exercise station 110 comprising a frame 112, and pivotably coupling a seat assembly 140 to the frame 112. In certain embodiments, a method of manufacturing an exercise station may comprise coupling a seat that is moveable between a first position that accommodates use of the exercise apparatus by a user sitting on the seat and a second position that accommodates use of the exercise apparatus by a user seated in a wheelchair to a frame.

In some embodiments, a method of manufacturing a seat assembly 140 may comprise fixedly attaching a seat 142 to an anchor 152 and coupling the anchor 152 to a seat base 150 comprising holes and a stop 146. In some embodiments, a method of manufacturing a seat assembly 140 further comprises providing a horizontal portion of a stop 146 adapted to contact a surface, such as the surface of a retaining element 120 or the ground or floor, to inhibit movement of the seat 142. A method of manufacturing a seat assembly 140 may further comprise providing a vertical portion of a stopping mechanism 146 to contact, latch, or lock to a retaining element 120.

In certain embodiments, a method of manufacturing a seat assembly 140 may comprise providing a lever 162 that extends substantially horizontally below the surface of the seat 142 and substantially vertically beside the seat anchor 152 and seat base 150, and a pin 170 attached to the vertical portion 168 of the lever 162, wherein the pin 170 is adapted to pass through a hole in the anchor 152 and a corresponding hole in the base 150 to maintain the seat 142 at the desired height.

In some embodiments, a method of manufacturing a seat assembly 140 may comprise coupling a seat base 150 to a seat support member 144 and a biasing element 148. In some embodiments, a method of manufacturing a seat assembly 140 may further comprise providing a biasing element 148, which, when no load is placed on the seat 142, is sufficient to bias the seat base 150 to disengage a stopping mechanism. In some embodiments, the biasing element 148 biases the seat base 150 upwards such that, when no weight is placed on the seat 142, the biasing element 148 causes the seat base 150 to raise, thereby eliminating any contact by the seat base 150 or a stop 146 with a surface. In such an embodiment, the seat 142 may be moved from a first position to a second position without any vertical lifting by a user. In some embodiments, a method of manufacturing a seat assembly 140 may further comprise providing a biasing element 148 such that, when a weight is placed on the seat 142, the biasing element 148 depresses and the seat base 150 lowers to engage a stopping mechanism 146.

In certain embodiments, a method of adjusting the height of seat 142 of an exercise station 110 comprises grabbing the edge of the seat 142 with a single hand, using the fingers of said hand to lift a lever 162 positioned beneath the seat 142, thereby releasing a pin 170 from holes in an anchor 152 and base 150, lifting or lowering the seat 142 to the desired height, and releasing the lever 162 such that the pin 170 engages holes in the anchor 152 and base 150 to secure the seat 142 at the desired height.

Cantilever Design

The embodiments illustrated in FIGS. 1, 2, and 3 comprise a station frame 112 with a cantilever design. In one embodiment, the frame 112 comprises a back support structure 116, against which users may lean while performing the exercise. Such back support structures are common in various exercise stations, such as those used for shoulder press and chest press exercises. The back support structure 116 typically comprises padding 117, as shown in FIG. 2, to provide comfort to the user as the user performs the exercise. The angle of the back support structure 116 and/or the padding 117 may vary and may be adjustable.

In some embodiments, the cantilever design may allow a user in an electric wheelchair to perform the exercise in substantially the same position as an able-bodied user performs the exercise with the seat in the first position. The cantilever design provides an opening below the back support structure 116, as shown in FIG. 2, such that any components of an electric wheelchair that extend rearward from the wheelchair do not prevent the user from using the exercise equipment in the conventional position. With the seat 142 in the second position, the wheelchair user may back the wheelchair into position, such that his or her back is substantially aligned with the back support structure 116 or the padding 117. The opening enables users confined to wheelchairs, and particularly electric wheelchairs, to perform the exercise in substantially the same position as able-bodied users perform the exercise when the seat is in the first position. In some embodiments, the distance between the bottom of the back support structure 116 and the ground is at least 12 inches. In some embodiments, the distance between the bottom of the back support structure 116 and the ground is between is between about 12 and about 24 inches. In some embodiments, the distance between the back support structure and the ground is about 18 inches.

In embodiments in which the frame 112 comprises a retaining member 120, the retaining member 120 should be sufficiently low profile that an electric wheelchair can move into position with its wheels on each side of the retaining member 120. In some embodiments, the height of the retaining member 120 is between 0.25 and 4 inches. In some embodiments, the height of the retaining member is about 2 inches.

Adjustable Arm Assembly

Figure 7:
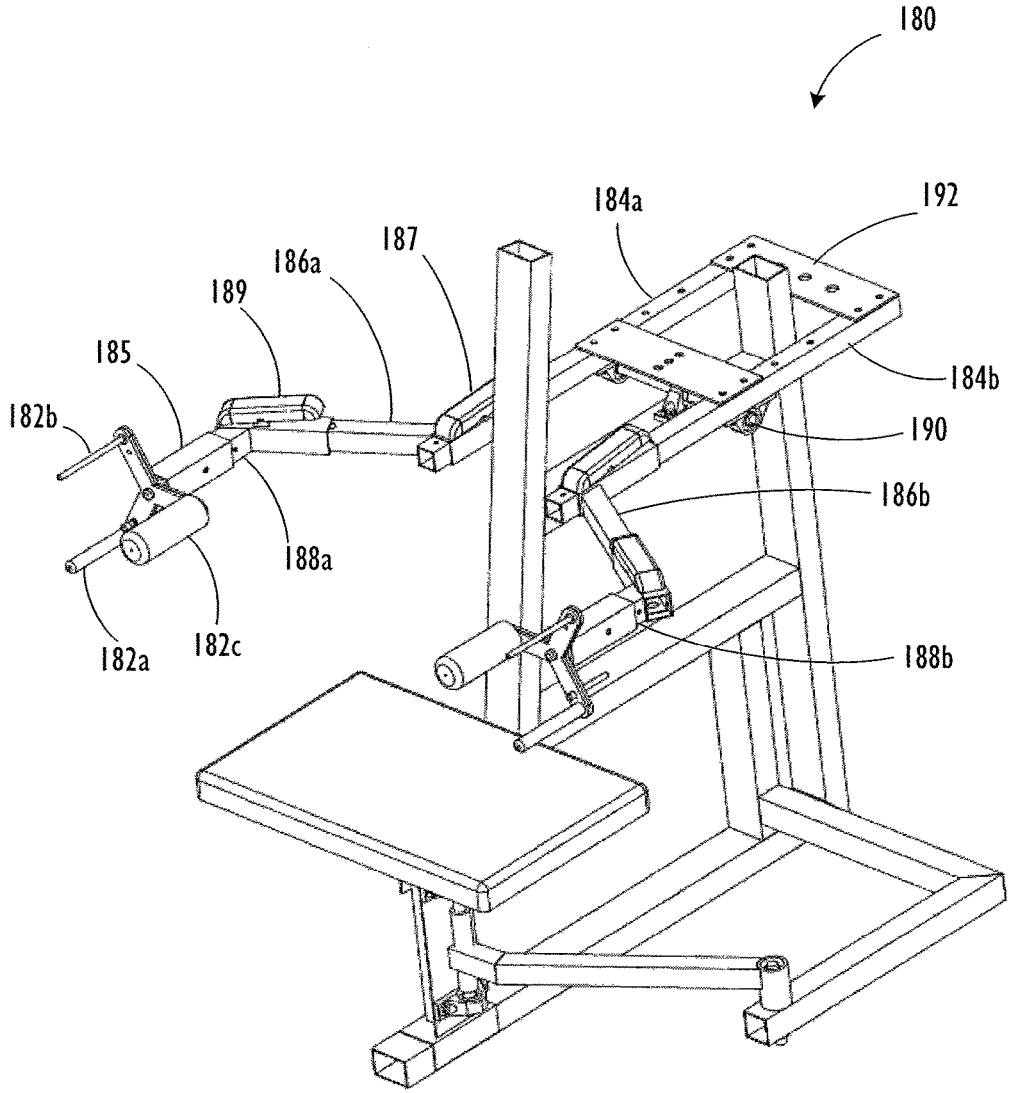
FIG. 7 is a top perspective view of an example embodiment of an exercise station having an adjustable arm assembly that may be used, for example, in a station for performing shoulder press exercises.

The exercise apparatus disclosed herein may comprise an arm assembly 180. An example of an adjustable arm assembly disclosed herein is illustrated in FIG. 7. An adjustable arm assembly may be used for performing exercises such as the shoulder press, chess press, shoulder shrug exercises, or the like. The arm assembly may comprise one or more handles 182, and is coupled to a resistance system (not shown). The arm assembly 180 may be adjustable, thereby allowing a user to adjust the location of the handles 182, which the user grips while performing the exercise.

The arm assembly 180 may comprise a primary element 184, an extension element 186, and a handle element 188. In some embodiments, the extension element 186 may extend at an angle from, and may be adjustable relative to, the primary element 184. For example, the extension element 186 may comprise an adjustment mechanism 187 that enables the extension element 186 to move relative to the primary element 184. For example, in the embodiment illustrated in FIG. 7, the adjustment mechanism is a sleeve, which allows the user to slide the extension element 186 relative to the primary element 184. Although a sleeve system is illustrated herein as an example of one type of adjustment mechanism 187, those of skill in the art will recognize that various other mechanisms may be used. Thus, a user may adjust the location of the handles 182 by adjusting the position of the extension member 186 relative to the primary element 184 using the adjustment mechanism 187. In the embodiment illustrated in FIG. 7, the adjustable extension element 186 may allow the user to move the handles 182 forward or backward relative to the user when the user is in the exercise position.

The extension element 186 may extend from the primary element 184 in any direction and at any angle. The angle may be adjustable by, for example, adjustment mechanism 187. The length of the extension element 186 may also vary and the desired length may depend on the angle at which it extends from the primary element 184 and the maximum distance desired between the handles 182. Although FIG. 7 illustrates the handle element 188 at the same height as the primary element 184, in some embodiments the extension element 186 may also extend vertically (upwards or downwards) from the primary element 184, such that the handle element 188 is above or below the height of the primary element 184. For example, in some embodiments, the sleeve 187 may be rotatable about the primary element 184, such that the user can adjust and select the height of the handles 182. By way of example only, in some embodiments, the primary element 184, or a portion thereof, and the sleeve 187, may be cylindrical, thereby allowing the sleeve 187, and thus the extension element 186, to rotate about the primary element 184. Other adjustment mechanisms 187 may also allow the extension element 186 to rotate and/or slide relative to the primary element 184. In some embodiments, the extension element 186 is adapted to rotate in a full circle about the primary element 184 and, as a result, the handle 182 also moves in a full circle, providing numerous potential handle locations.

In some embodiments, the arm assembly 180 may comprise first and second primary elements, first and second extension elements, and first and second handle elements. In the embodiment illustrated in FIG. 7, which is provided as an example only, the arm assembly 180 comprises a first primary element 184*a* and a second primary element 184*b*, a first extension element 186*a* coupled to the first primary element 184*a*, a second extension element 186*b* coupled to the second primary element 184*b*, a first handle element 188*a* coupled to the first extension element 186*a*, and a second handle element 188*b* coupled to the second extension element 186*b*. In some embodiments, the first and second primary elements 184*a*, 184*b* are rigidly coupled such that the entire arm assembly 180 moves as a unit when either handle element 188*a* or 188*b* is lifted. Optionally, the first and second primary elements 184*a*, 184*b* may be independently operable, such that when a user performs an exercise using only the first handle element 188*a*, the first primary element 184*a* and the first extension element 186*a* would move but the second primary element 184*b*, second extension element 186*b*, and second handle element 188*b*, would not move. In some embodiments, the two or more handle elements 188*a* and 188*b* are independently operable and are connected to independent resistance systems, such that a different amount of resistance may be selected for each handle 188.

The handle element 188 may be either fixed or moveable relative to the extension element 186. As illustrated in FIG. 7, in some embodiments, the handle element 188 comprises a sleeve 189, which allows the handle element 188 to move relative to the extension element 186. As previously described in connection with the adjustability of the extension element 186 relative to the primary element 184, the handle element may be coupled to the extension element 186 in such a way that the handle element 188 is slideable, or rotatable, or both, relative to the extension element 186, thereby providing the user with numerous potential handle locations. In some embodiments, the handle element comprises the handle 182. The handle 182 may comprise foam, rubber, or other material known in the art to provide increased grip and comfort during exercise.

In certain embodiments, a method of manufacturing an arm assembly 180 may comprise providing an extension element 186 that is coupled to a primary element 184. In some embodiments, a method of manufacturing an arm assembly 180 may further comprise coupling a handle element 188 to the extension element 186. In some embodiments, a method of manufacturing an arm assembly may further comprise coupling a handle assembly 185 to the handle element 188. In some embodiments, a method of manufacturing an arm assembly may further comprise providing two or more distinct handles 182 on a handle assembly, and coupling the handle assembly 185 to the handle element 188.

In some embodiments, the arm assembly 180 may be counter-balanced, so that the effective weight or resistance of the arm assembly 180 itself is reduced. Reducing the weight of the arm assembly 180 may be desirable because some users may not be able to lift the weight of the arm assembly 180. Counter-balancing may be achieved by establishing a pivot point 190 for the adjustable arm assembly 180, and adding weight 192 to the portion of the adjustable arm assembly 180 that is opposite the handles 182. Any amount of weight may be used to counter-balance the weight of the adjustable arm assembly 180 that is forward of the pivot point 190. In some embodiments, sufficient counter-balance weight is applied such that it offsets the weight of the portion of the adjustable arm assembly 180 that is forward of the pivot point 190, thereby rendering the arm assembly 180 virtually weightless to the user, unless additional resistance from the resistance system 180 is selected. The effective weight of the arm assembly 180 itself may vary based on the amount of weight on each side of the pivot point 190. The amount of counter-balancing may be selected by adding weight to the side of the arm assembly 180 opposite the handles, or by moving the pivot point. In some embodiments, the counter-balance is selected such that the effective weight or resistance to a user performing the exercise (without any additional resistance selected from the resistance system) is less than 10 pounds. In some embodiments, the effective weight of the arm assembly 180 is between about 1 and about 5 pounds.

In certain embodiments, a method of manufacturing an exercise apparatus 100 comprises coupling an exercise station 110 comprising an arm assembly 180 to a resistance system 180. In some embodiments, a method of manufacturing may further comprises defining a pivot point 190 for the arm assembly 180, and applying weight to the portion of the arm assembly 180 that is on the opposite side of the pivot point as the handles 182, thereby counterbalancing at least a portion of the weight of the arm assembly. In certain embodiments, a method of manufacturing an arm assembly 180 comprises providing independently operable primary elements 184*a* and 184*b*, such that when one of the primary elements (184*a*) is activated by a user performing the exercise, the other primary element (184*b*) does not move. Such a manufacturing method provides an arm assembly 180 by which the user can alternate between left-handed and right-handed exercises. In some embodiments, a method of manufacturing an arm assembly comprises rigidly coupling the primary elements 184*a* and 184*b*.

Handle Assembly

The adjustable arm assembly 180 may comprise any type of handle 182 conventionally used for weight-bearing exercise equipment. In some embodiments, the handle may be integral with the handle element 188. Alternatively, as illustrated in FIG. 7, the arm assembly 180 may include a handle assembly 185. The handle assembly 185 may comprise a plurality of handles 182*a*, 182*b*, 182*c*, etc., each of which may provide a different size or type of handle, or a different handle orientation.

The handle assembly 185 illustrated in FIG. 7 comprises three handles, 182*a*, 182*b*, 182*c*. Handle 182*a* may be suitable for users capable of grasping the handle 182*a* with a bare hand, as is found on conventional exercise equipment. For example, the handle 182*a* may comprise a rigid cylindrical element surrounded by rubber or foam. As those of skill in the art will appreciate, handles suitable for users capable of grasping the handle 182*a* may comprise a variety of shapes, sizes, and materials.

Alternative handles 182*b* and 182*c* may be suitable for users with little or no capability of grasping a conventional handle. For example, handle 182*b* may be a rigid cylindrical element with no protective covering, which will accommodate users wearing a cuffing device, which wraps around the user's hand to compensate for lack of grip. As another example, handle 182*c* may comprise a rigid element at least partially surrounded by a foam roller of sufficient size to allow the user to place the roller in their palms and perform the exercise without tightly grasping the handle. In some embodiments, the various handle types 182*a*, 182*b*, 182*c* may be removable from the handle assembly 185. For example, in the embodiment illustrated in FIG. 7, the handle assembly may comprise three rigid cylindrical elements. Various grips may then be placed over each of the cylindrical elements, such that the types of "grip" for each handle 182*a*, 182*b*, 182*c* are interchangeable.

In some embodiments, the handle assembly 185 may be rotatable relative to the handle element 188. This allows the user to place any particular handle, for example handles 182*a*, closer to or farther away from the user. The handle assembly 185 may contain any number of individual handles.

In some embodiments, the handle assembly 185 may comprise multiple handles 182*a*, 182*b*, 182*c* with the same grip. This will allow the user to perform the exercise with their hands in different locations without rotating the handle assembly 185. In some embodiments, the handles may extend at different orientations. For example, in some embodiments a first handle 102*a* may extend vertically, whereas a second handle 102*b* may extend horizontally.

In certain embodiments, a method of manufacturing a handle assembly comprises providing two or more handles. In certain embodiments, a method of manufacturing a handle assembly further comprises providing at least two distinct types of grips on the handles. In certain embodiments, a method of manufacturing a handle assembly comprises providing three handles 182*a*, 182*b*, and 182*c*, the handle assembly being rotatable with respect to the handle element 188, such that the user may select the desired handle type by rotating the handle assembly.

Resistance Systems

The exercise apparatus 100 may comprise a resistance system 102 for performing the exercises. The resistance may be provided using a weight stack and a cable and pulley system as is well known in the art. Alternatively, resistance may be provided by hydraulic systems, rubber bands, flexible resistance bars, or any other means for providing resistance.

In some embodiments, the resistance system 102 may comprise one or more weight stacks. FIG. 1 illustrates one example of a multiple weight stack system disclosed herein. The resistance system 102 may include two weight stacks: a primary weight stack 104*a*, and a secondary weight stack 104*b*. Each weight stack may comprise individual plates. In some embodiments, all of the individual plates in the primary weight stack are the same weight. In some embodiments, all of the individual plates in the secondary weight stack are the same weight. In some embodiments, the weight of the individual plates in the primary weight stack is different than the weight of the individual plates in the secondary weight stack. For example, the primary weight stack 104*a* may comprise plates weighing ten pounds each, while the secondary weight stack 104*b* may comprise plates weighing one pound each. As those of skill in the art will appreciate, the weight of the individual plates in the primary weight stack may vary. For example, the individual plates in the primary weight stack 104*a* may each be between 10 and 100 pounds, more typically between 10 and 50 pounds. Similarly, the weight of the individual plates in the secondary weight stack may vary. For example, the individual plates in the secondary weight stack 104*b* may be between 0.5 and 10 pounds, more typically between 1 and 5 pounds.

In some embodiments, the weight stacks 104*a* and 104*b* may be coupled together, such that when the user of the exercise station 110 performs an exercise, the resistance is provided by the selected weight of both weight stacks 104*a* and 104*b*. In the embodiment shown in FIG. 1, the weight stacks are coupled together using a cable and pulley system. The cable is shown from the weights to the point at which the cables are connected, thereby coupling the weight stacks. In some embodiments, a single cable extends from that coupling point to the arm assembly of the exercise station 110. The routing of cable from the weight stack to the exercise station is well known in the art and, therefore, the cables are not shown in the Figures. The dual weight stack system disclosed herein allows the user to adjust the amount of resistance, for example, in increments equal to the weight of the individual plates in the primary weight stack 104*a*, or in increments equal to the weight of the individual plates in the secondary weight stack 104*b*.

The weight of the individual plates in the secondary stack, as well as the total weight of the secondary stack, may be selected based on the weight of the individual plates in the primary weight stack. For example, if the individual plates in the primary weight stack 104*a* are 5 pound weights, the secondary weight stack 104*b* may comprise individual plates of 0.5 pounds or 1 pound, to provide the user with the option to select from smaller incremental weight increases. However, if the individual plates in the primary weight stack 104*a* are 50 pounds, the individual plates in the secondary weight stack 104*b* may be 5 or 10 pounds. In some embodiments, the total amount of weight in the secondary weight stack is selected to be equal to, or slightly less than, the weight of an individual plate in the primary weight stack.

For example, if the primary weight stack 104*a* comprises thirty individual plates weighing 10 pounds each, a typical exercise apparatus comprising a single weight stack would allow the user to perform the exercise in 10-pound increments from 10 pounds to 180 pounds. Using a dual weight stack system described herein, however, the resistance system may comprise, for example, a primary weight stack comprises thirty individual plates of 10 pounds and a secondary weight stack comprising nine individual plates weighing 1 pound each. Such a configuration provides the user with the ability to increase the resistance in 1-pound increments, from a minimum of 1 pound to a maximum of 309 pounds.

The use of multiple weight stacks (or another form of resistance) is particularly useful for exercise equipment configured for use by individuals with disabilities. Many conventional exercise stations allow the user to adjust the weight only by relatively large increments, often five pounds, ten pounds, or more. Such increments are often too large for persons with disabilities, who may be able to perform the exercise at one resistance level, but may be unable to perform any exercises at the next available resistance level. By providing a system with multiple resistance increments, users can gradually increase the resistance in small increments. As will be readily apparent to those of skill in the art, any combination of weights may be used in the weight stacks 104*a* and 104*b*, and more than two weight stacks may be used. In addition, other forms of resistance may be used.

As shown in FIG. 1, the resistance system 102 may be configured to allow the user of the exercise apparatus 100 to change the amount of resistance while sitting in the position in which the exercise will be performed. Such a configuration significantly increases the ease of use for users that may be confined to a wheelchair or otherwise cannot easily move in and out of the exercise position.

By way of example only, various features of the embodiments disclosed herein are described in connection with a shoulder press exercise machine, as illustrated in FIG. 1. However, as will be apparent to one of skill in the art based on the description herein, the various features described herein may be applied to exercise equipment for any particular exercise, and are not limited to shoulder press exercise stations.

Alternative Arm Assemblies

Figure 8:
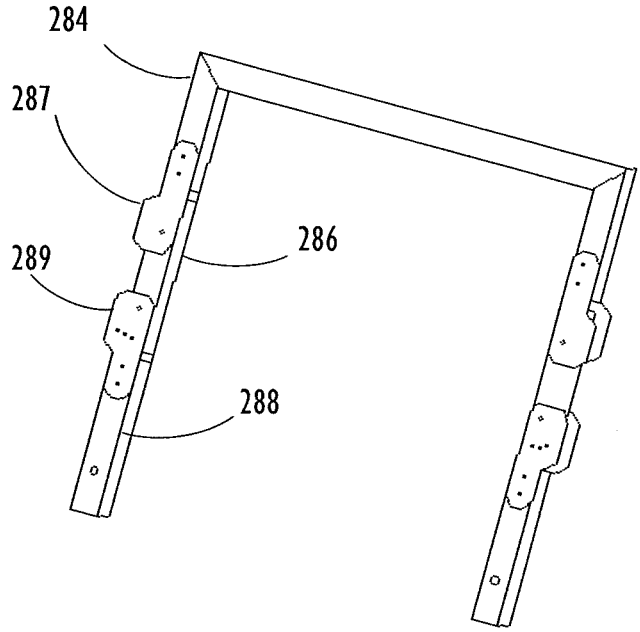
FIG. 8 is a perspective view of an example embodiment of an adjustable arm assembly that may be used, for example, in a station for performing chest press exercises.
Figure 9:
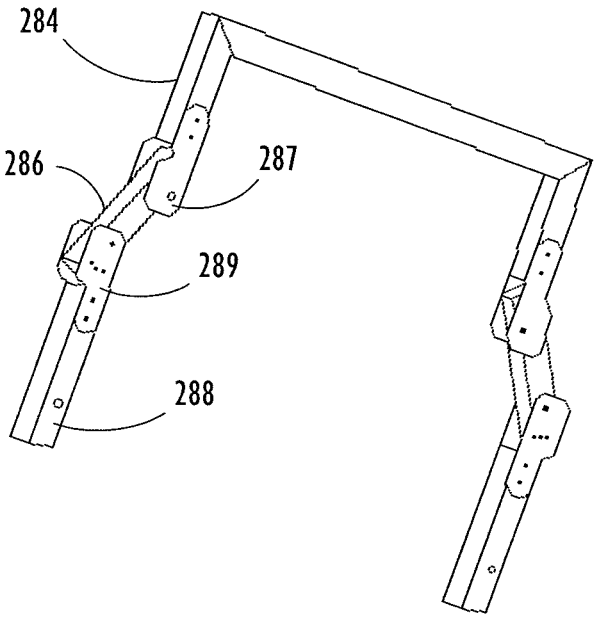
FIG. 9 is a perspective view of an example embodiment of an adjustable arm assembly that may be used, for example, in a station for performing chest press exercises.

The configuration of the arm assembly may vary depending on the exercise. By way of example only, FIGS. 8 and 9 are provided to illustrate components of an adjustable arm assembly according to an example embodiment for a chest press exercise station. The embodiment illustrated in FIGS. 8 and 9 comprise a primary element 284, an extension element 286, and a handle element 288. The arm assembly may comprise a first adjustment mechanism 287, which allows the extension element to extend at various angles from the primary element 284, and/or a second adjustment mechanism 289, which allows the handle element 288 to extend at various angles from the extension element 286. In the embodiment shown in FIGS. 8 and 9, the adjustment mechanisms 287, 289 comprise a rotating pin system, which allows the user to increase or decrease the distance between the handles (not shown) by varying the angles between the elements of the arm assembly. FIG. 9 illustrates one possible alternative configuration for the adjustable arm assembly shown in FIG. 8. As those of skill in the art will recognize, certain characteristics of the frame of an exercise apparatus having the novel features disclosed herein may vary depending on the exercise. For example, a frame for a chest press, seated row, or pull down may extend above the users head such that the arm assembly will extend downward towards the user.

In some embodiments, the exercise station is for performing seated rowing exercises, and an arm assembly similar to the assembly shown in FIGS. 8 and 9 can be used. For some exercises, such as a rowing exercise, a user may perform the exercise facing the frame. For such exercises, the back support structure previously described may be replaced by a padded chest support structure. Thus, when the seat is in the first position (as shown), a user may sit on the seat, lean his or her chest against the chest support structure, and perform the exercise by pulling on handles of the arm assembly. As previously described, the seat may be moved to a second position, which allows a user in a wheelchair to use the station. In some embodiments, the location of the chest support may be adjustable.

Figure 10:
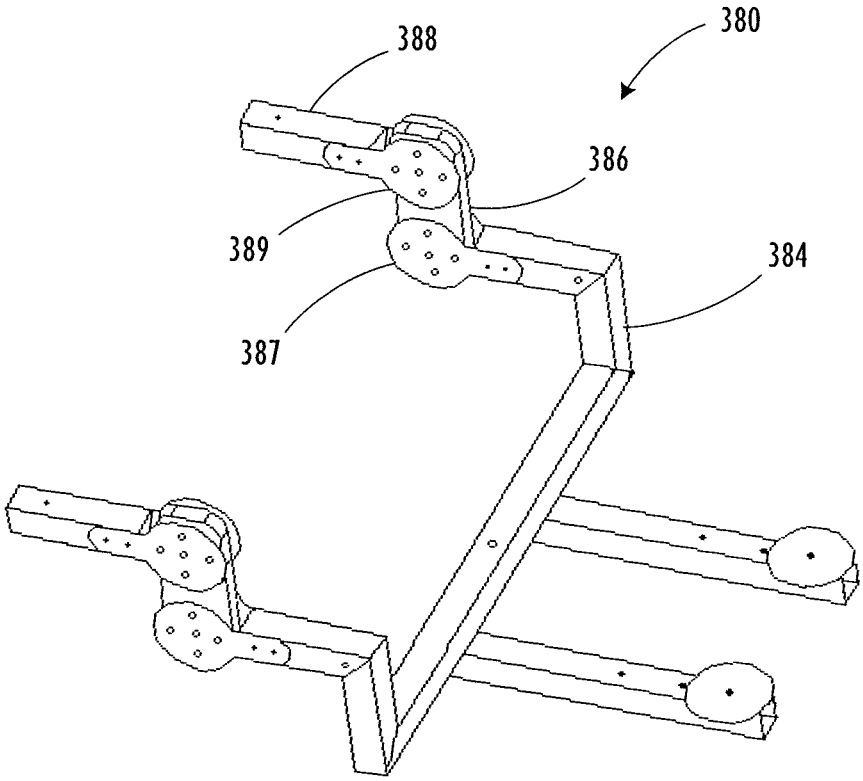
FIG. 10 is a perspective view of an example embodiment of an adjustable arm assembly that may be used, for example, in a station for performing shoulder shrug exercises.
Figure 11A:
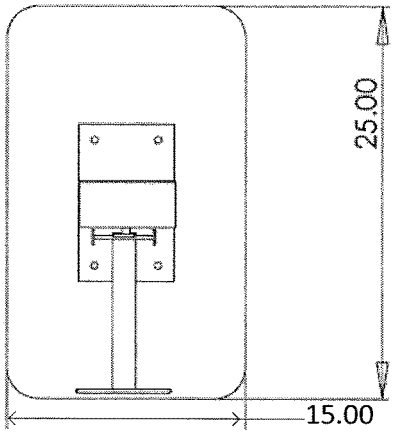
FIGS. 11A-11E provide perspective views of a seat in an example embodiment of a seat assembly.
Figure 11B:
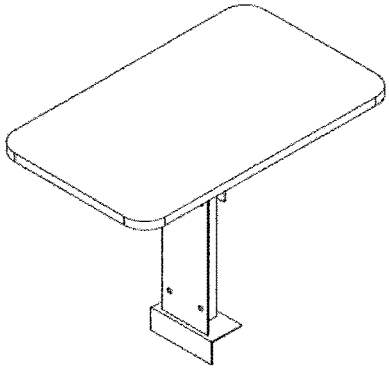
Figure 11C:
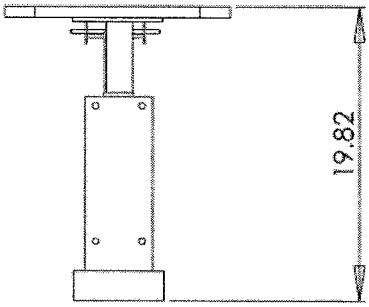
Figure 11D:
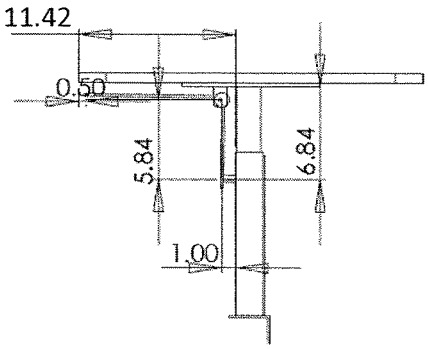
Figure 11E:
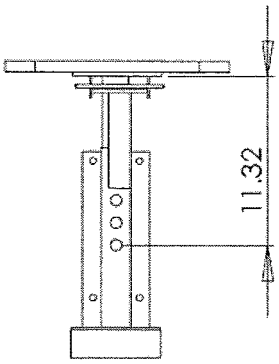

FIG. 10 illustrates an alternative adjustable arm assembly 380 as disclosed herein for use with an exercise station configured such that the user can perform a shoulder shrug exercise. The arm assembly 380 may comprise a primary element 384, an extension element 386, and a handle element 388. The arm assembly further comprises a first adjustment mechanism 387 that allows the user to adjust the angle at which the extension element 386 extends from the primary element 384, as well as a second adjustment mechanism 389 that allows the user to adjust the angle at which a handle assembly 388 extends from the extension element 386. Alternatively or additionally, the arm assembly for shoulder shrug exercises may comprise adjustments that increase or decrease the distance between the handles, allowing for individuals of a wide range of sizes, including obese individuals, to use the station.

The foregoing description sets forth various examples of non-limiting embodiments. While the description gives some details regarding illustrative combinations and modes of the disclosed embodiments, other variations, combinations, modifications, modes, and/or applications of the disclosed feature and aspects of the embodiments are also within the scope of this disclosure, including those that become apparent to those of skill in the art upon reading this specification. In particular, it is contemplated that the various materials, dimensions, angles, shapes, sizes, and structures of each of the different disclosed embodiments may be used interchangeably and/or combined to form other embodiments. The scope of the inventions claimed herein is not limited by the foregoing description; rather, the scope is limited only by the claims.

What is claimed is:

1. An exercise apparatus comprising:

a frame;

a seat assembly coupled to the frame, the seat assembly comprising:

a seat;

a base coupled to the seat;

a stop coupled to the base and configured to engage a surface to inhibit lateral movement of the seat when a user sits on the seat to perform an exercise; and a biasing element coupled to the base and biased to disengage the stop from the surface when no force is exerted on the seat, wherein the seat assembly is configured to move, relative to the frame, such that the seat is moveable between a first position, which accommodates use of the exercise apparatus by a user sitting on the seat, and a second position, which accommodates use of the exercise apparatus by a user seated in a wheelchair.

2. The exercise apparatus of claim 1, wherein the seat assembly is pivotably attached to the frame.

3. The exercise apparatus of claim 2, wherein a user's weight when the user is sitting on the seat in the first position causes the stop to engage a surface to inhibit lateral movement of the seat.

4. The exercise apparatus of claim 3, wherein the stop comprises a horizontal portion adapted to frictionally engage the surface.

5. The exercise apparatus of claim 4, wherein the frame comprises a retaining element and the stop frictionally engages a surface of the retaining element.

6. The exercise apparatus of claim 5, wherein the biasing element has a vertical bias that raises and disengages the stop when no downward force is exerted on the seat and lowers and engages the stop when the seat is in the first position and a user sits on the seat.

7. The exercise apparatus of claim 4, wherein the surface is a surface on which the exercise apparatus is placed.

8. The exercise apparatus of claim 6, wherein the stop comprises a vertical portion adapted to engage a second surface of the retaining element when the seat is in the first position.

9. The exercise apparatus of claim 7, wherein the seat is moveable between the first and second positions without any vertical lifting force.

10. The exercise apparatus of claim 2, further comprising a resistance system and an arm assembly.

11. A seat assembly for an exercise apparatus, the seat assembly comprising:

a seat coupled to a base;

a seat support member coupled to the base and configured to be coupled to a frame of an exercise station;

a stop coupled to the base and configured to inhibit movement of the seat by engaging at least one surface of the frame or a surface on which the exercise apparatus is placed;

a biasing element that is vertically biased to raise the seat and base, and to disengage the stop from the at least one surface when no downward force is exerted on the seat, wherein the seat support member is configured to be pivotably attached to the exercise station such that the seat is moveable between a first position and a second position, wherein the first position accommodates use of an exercise station by a user sitting on the seat and wherein the second position accommodates use of the exercise station by a user seated in a wheelchair.

12. The seat assembly of claim 11, wherein the exercise station comprises a frame and an extension, and wherein the seat support member is configured to be pivotably attached to the extension.

13. The seat assembly of claim 11, wherein the stop comprises a horizontal portion adapted to engage a first surface of a retaining element and a vertical portion adapted to engage a second surface of a retaining element.

14. The seat assembly of claim 13, wherein the horizontal portion is configured to frictionally engage the first surface of the retaining element when the seat is in the first position and a user is sitting on the seat.

15. The seat assembly of claim 13, wherein the vertical portion is configured to engage the second surface of the retaining element when the seat is in the first position.

16. The seat assembly of claim 11, further comprising:

a seat anchor rigidly coupled to the seat and moveable relative to the base; and a seat height adjustment mechanism.

17. The seat assembly of claim 16, wherein the seat height adjustment mechanism comprises a lever that extends substantially horizontally beneath the seat and allows a user to place a palm of one hand on an edge of the seat and actuate the lever with the user's fingers.

18. The seat assembly of claim 17, wherein the seat height adjustment mechanism comprises a lever that extends substantially horizontally beneath the seat and terminates at a point that is less than one inch in a horizontal direction from the edge of the seat.

* * * * *